US007170229B2

(12) United States Patent
Hirao

(10) Patent No.: US 7,170,229 B2
(45) Date of Patent: Jan. 30, 2007

(54) SHORT ARC TYPE SUPER HIGH PRESSURE DISCHARGE LAMP

(75) Inventor: Tetuji Hirao, Hyogo (JP)

(73) Assignee: Ushio Denki Kabushiki Kaisha, Tokyo (JP)

( * ) Notice: Subject to any disclaimer, the term of this patent is extended or adjusted under 35 U.S.C. 154(b) by 242 days.

(21) Appl. No.: 10/828,216

(22) Filed: Apr. 21, 2004

(65) Prior Publication Data

US 2004/0256992 A1 Dec. 23, 2004

(30) Foreign Application Priority Data

Apr. 22, 2003 (JP) ..... 2003-117228

(51) Int. Cl.
*H01J 17/04* (2006.01)
*H01J 17/20* (2006.01)

(52) U.S. Cl. ..... 313/631; 313/574; 313/639

(58) Field of Classification Search ..... 313/416, 313/570, 571, 574, 623, 625, 631, 639, 572, 313/567

See application file for complete search history.

(56) References Cited

U.S. PATENT DOCUMENTS 5,109,181 A 4/1992 Fischer et al.
5,497,049 A 3/1996 Fischer
6,369,509 B1 * 4/2002 Ookubo et al. ..... 313/623
6,407,504 B1 * 6/2002 Niimi ..... 313/623
6,433,479 B1 * 8/2002 Higashimoto et al. ..... 313/623
2001/0003411 A1 * 6/2001 Honda et al. ..... 313/607
2003/0048076 A1 * 3/2003 Kanzaki et al. ..... 313/571

FOREIGN PATENT DOCUMENTS

JP 06-052830 A1 2/1994
JP 10-269941 A1 10/1998

* cited by examiner

*Primary Examiner*—Edward J. Glick
*Assistant Examiner*—Irakli Kiknadze
(74) *Attorney, Agent, or Firm*—Rader, Fishman & Grauer PLLC

(57) ABSTRACT

A short arc type super high pressure discharge lamp has a pair of electrodes, a light emitting portion in which greater than 0.15 mg/mm$^3$ of mercury is enclosed, and sealing portions provided on both sides of the light emitting portion, wherein at least one of the pair of electrodes has a thick portion which extends into one of the sealing portions and a coil is wound around the thick portion in the one of the sealing portion via a gap.

12 Claims, 3 Drawing Sheets

SHORT ARC TYPE SUPER HIGH PRESSURE DISCHARGE LAMP

TECHNICAL FIELD OF THE INVENTION

The present invention relates to a short arc type super high pressure discharge lamp whose mercury vapor pressure at time of lighting becomes greater than 150 atm, and especially to a short arc type super high pressure discharge lamp used as a backlight of a projector apparatus such as a liquid crystal display apparatus, a projector apparatus such as DLP (a digital light processor) in which a DMD (a digital mirror device) is used.

DESCRIPTION OF THE RELATED ART

Since such a projection type projector apparatus is required to uniformly emit an image with sufficient color rendition onto a rectangular screen, a metal halide lamp encapsulating mercury or metal halide is employed as a light source. In addition, such a metal halide lamp has been further miniaturized and made as a point light source, and furthermore halide lamps having an extremely short distance between electrodes have been put to practical use.

With such developments, recently, instead of such halide lamps, a lamp having extremely high mercury vapor pressure of, for example, greater than 200 bar (197 atm), has been proposed. In such a lamp, the increase of mercury vapor pressure controls spread of arc and improves further light output.

Such an ultra high pressure discharge lamp is disclosed in, for example, Japanese Laid Open Patent Nos. 2-148561 (U.S. Pat. No. 5,109,181) and 6-52830 (U.S. Pat. No. 5,497,049).

On the other hand, in the projector apparatus, a liquid crystal panel is not required since the DLP (digital light processor) method using DMD (micro mirror device) is adopted, and, thereby, miniaturization of the apparatus is attracting attention.

That is, while a discharge lamp used as a projector light source for a projector apparatus requires a high optical output or a high illumination maintaining rate, miniaturization of the discharge lamp is required so as to fit in the projector apparatus.

SUMMARY OF THE INVENTION

It is an object of the present invention to provide a super high pressure mercury lamp having a structure with sufficiently high pressure resistance.

The object of the present invention is solved by a short arc type super high pressure discharge lamp having a pair of electrodes, a light emitting portion in which greater than 0.15 mg/mm$^3$ is enclosed, and sealing portions provided on both side of the light emitting portion, wherein at least one of the pair of electrodes has a thick portion which extends into one of the sealing portions and a coil is wound around the thick portion in the one of the sealing portion via gap.

The at least one of the pair of electrodes may be an anode and the short arc type super high pressure discharge lamp may be a direct current type discharge lamp.

The width of the gap may be 0.03 to 0.3 mm. The thick portion of the one of the electrodes may have a reduced thick portion whose diameter is greater than 70% of a maximum diameter of the thick portion in the light emitting portion. The coil may be made of tungsten with a purity of greater than 4 N.

The present invention will become more apparent from the following detailed description of the embodiments and examples of the present invention.

DETAILED DESCRIPTION OF THE INVENTION

Embodiments of the present invention will be described below with reference to the accompanying drawings.

Figure 1:
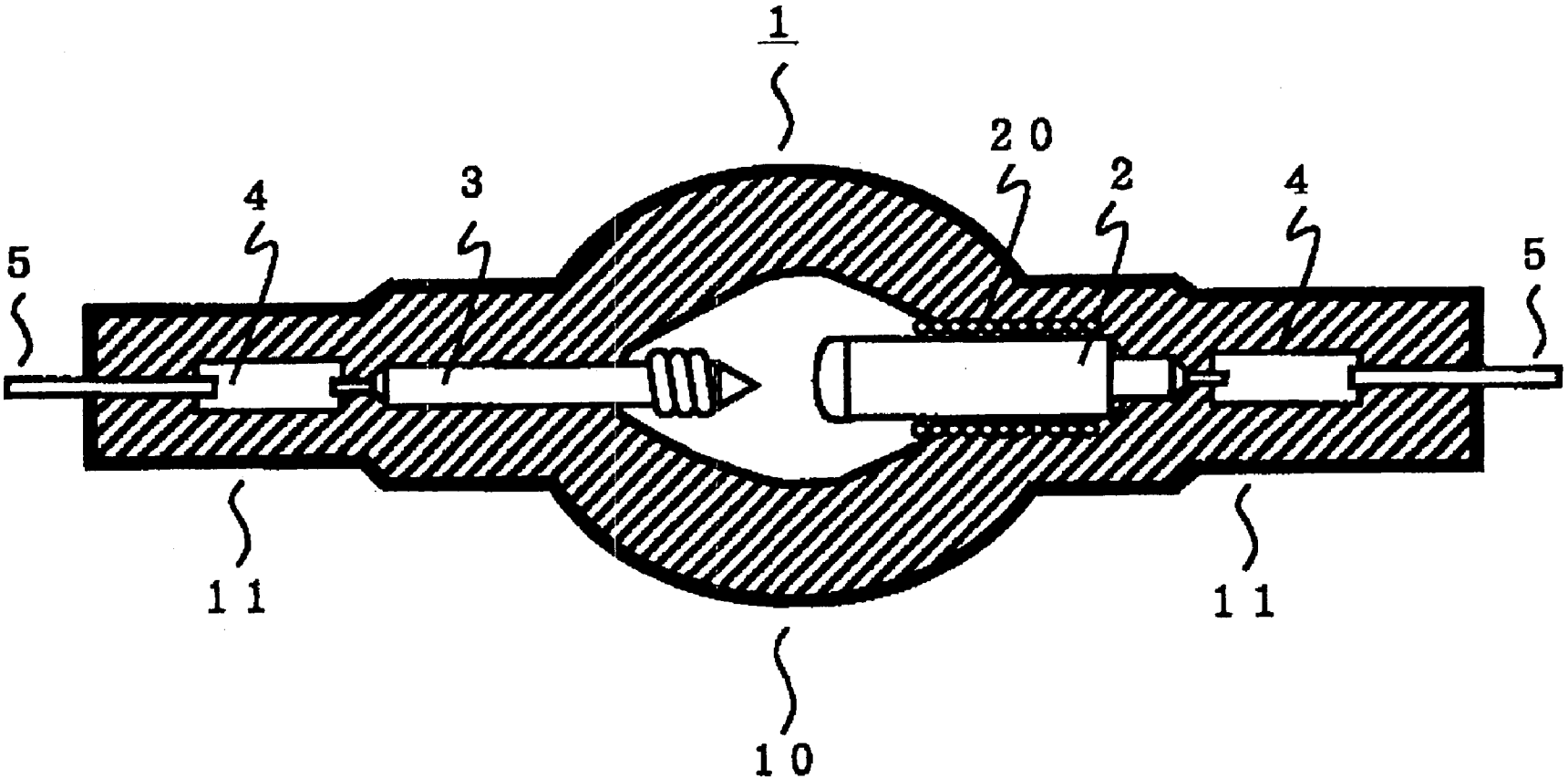
FIG. 1. is a cross sectional view of a short arc type high pressure discharge lamp according to the present invention.

FIG. 1 is a cross sectional view of a short arc type high pressure discharge lamp 1 (hereinafter referred to merely as "a discharge lamp") according to the present invention.

The discharge lamp 1 has a light emitting portion 10 which is approximately spherical. The light emitting portion 10 is formed as part of a discharge container made of silica glass. In the light emitting portion 10, an anode 2 and a cathode 3 are disposed so as to face each other. A sealing portion 11 is formed on each side of the light emitting portion 10 so as to extend therefrom. In each sealing portion 11, a metallic foils 4 for electric conduction is air-tightly buried by, for example, shrink-sealing. The metallic foils 4 are usually made of molybdenum. One end of one of the metallic foils 4 is connected to the anode 2, and one end of the other metallic foil is connected to the cathode 3. The other end of metallic foils 4 is connected to respective outside leads 5. A coil 20 is wound around the anode 2 with a gap. Details of the gap S will be given later.

Mercury, rare gas, and halogen gas are enclosed in the light emitting portion 10. Greater than 0.15 mg/mm$^3$ Mercury is encapsulated in order to obtain radiation light with visible light wavelength of, for example, 360 to 780 nm. Although the amount of enclosure changes depending on temperature conditions, when it is greater than 150 atm at time of lighting, the vapor pressure becomes very high. It is possible to produce high mercury vapor pressure discharge lamps whose mercury vapor pressure is greater than 200 or 300 atm at time of lighting by encapsulating more mercury. Therefore, it is possible to realize a light source suitable for the projector apparatus as the mercury vapor pressure is higher.

As the rare gas, for example, approximately 13 kPa of argon gas is encapsulated, thereby improving a start-up performance.

Halogen is enclosed in form of a compound of iodine, bromine, chlorine etc. with mercury and other metals. The amount of enclosed halogen may be selected from a range of, for example, $10^{-6}$ to $10^{-2}$ micro mol/mm$^3$, and although function thereof is to extend lifetime of the lamp using halogen cycles, according to the present invention, the extremely small size discharge lamp with high pressure, in which halogen is encapsulated has effects of preventing breakage of the discharge lamp and devitrification.

For example, the outer diameter of the light emitting portion 10 is selected in a range of $\phi$6.0 to 15.0 mm, such as 9.5 mm. A distance between the electrodes 2 and 3 is selected in a range of 0.5 to 2.0 mm, such as 1.5 mm. The volume of the light emitting tube is selected in a range of 40 to 300 $mm^3$, such as 75 $mm^3$. Further, for lighting condition, for example, a tube wall load is selected in a range of 0.8 to 2.0 $W/mm^2$, such as 1.5 $W/mm^2$. Rated voltage, and rated apparent power are 80 V, and 150 W, respectively.

In addition, the discharge lamp 1 is built in a projector apparatus which will be miniaturized, and while the entire structure of the apparatus is required to be miniaturized significantly, high light intensity is still required. Therefore, thermal condition in the light emitting portion is highly strict.

The discharge lamp is installed in a presentation apparatus such as a projector apparatus, and an overhead projector wherein radiation light with good color rendition can be obtained.

Figure 2A:
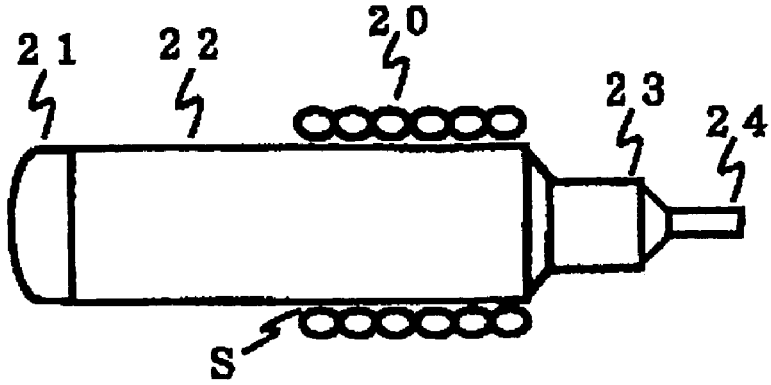
FIG. 2A is an enlarged view of the structure of the anode 2 shown in FIG. 1.
Figure 2B:
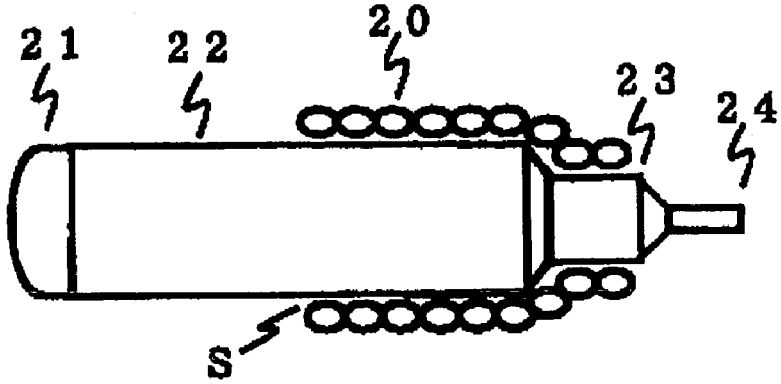
FIG. 2B shows another form of the anode 2 according to the present invention.
Figure 2C:
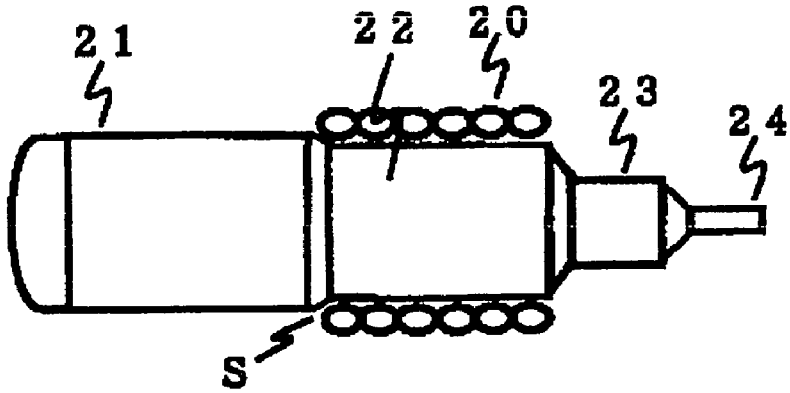
FIG. 2C shows still another form of the anode 2 according to the present invention.

FIGS. 2A, 2B, and 2C show an enlarged view of an anode 2 according to the present invention, respectively.

FIG. 2A is an enlarged view of the structure of the anode 2 shown in FIG. 1, wherein the anode 2 comprises a tip portion 21, a thick diameter portion 22, an intermediate portion 23, and a reduced diameter portion 24. A coil 20 is wound around the perimeter of the thick diameter portion 22 via a gap S.

FIG. 2B shows another form of the anode 2 according to the present invention, wherein the anode 2 is different from that shown in FIG. 2A in terms of winding the coil 20 around not only the thick diameter portion but also the intermediate portion 23.

FIG. 2C shows still another form of the anode 2 according to the present invention, wherein the anode 2 shown in FIG. 2C is different from that shown in FIG. 2A at the point which the tip portion 21 is extended, producing difference in level between the tip portion 21 and the thick diameter portion 22.

According to the discharge lamp 1 of the present invention, the anode 2 with the thick diameter is extended to a sealing portion 11 with almost no diameter change. Since, as mentioned above, the thermal conditions are very strict, and the light emitting portion 10 must be small, the anode 2 with the thick diameter is extended to the sealing portion 11 without diameter change in order to secure thermal capacity of the anode 2. That is, the discharge lamp 1 according to the present invention is different from that of the usual discharge lamp at the point which the diameter of the anode 2 according to the present invention is thick around the light emitting portion 10 but thin around the sealing portion 11.

In the discharge lamp 1 according to the present invention, the anode 2 with the thick diameter is extended inside the sealing portion 11, and in the sealing portion 11, the coil 20 is wound around the circumference of the thick diameter portion 22 via the gap S. The reason for forming the gap S is that if a sealing portion" made of silica glass and the anode 2 made of tungsten are in contact with each other at time of lighting, cracks on the silicate glass are formed due to thermal expansion coefficient difference therebetween when the discharge lamp 1 is turned off, and after that, if the discharge lamp 1 is turned on, there is possibility that these cracks grow.

Thus, it is possible to have a structure in which the anode 2 and the silica glass are not in contact with each other, by forming a gap therebetween. However, since the anode 2 with the thick diameter according to the present invention is extended to the sealing portion 11, it is difficult to maintain the required gap S completely due to the anode's own weight and manufacturing variations.

Since the discharge lamp 1 according to the present invention adopts the structure in which the coil 20 is provided around the circumference of the thick diameter portion 22 via the gap S so that the gap S which is required at a room temperature is maintained, even in case that the coil 20 and the electrode 2 are in contact with each other, only part thereof is in contact, that is, in no case is the coil 20 in contact with the entire circumference of the thick diameter portion, therefore, no cracks which cause the above problems are formed.

Since the coil 20 is not directly in contact with the anode 2, the coil 20 does not become high temperature as the anode 2 does. Therefore, since the temperature of the coil 20 is low, contact of the anode 2 with the silica glass does not result in cracks to the extent that it becomes a problem.

It is desirable that high melting point metal material which is the same as that of the anode 2 is used for the coil 20, and even when the anode 2 is made of tungsten, it is preferred to use tungsten as the material of the coil 20. In the discharge lamp 1 which falls in the range described in the discharge lamp specification which is mentioned above, the width of the gap S is preferably 0.03 to 0.3 mm. The reason that the width of the gap S is preferably 0.03 mm or greater, is that it is possible to prevent contact between the anode 2 and the coil 20, even taking thermal expansion of the anode 2 into consideration. For example, the temperature of the body of the anode 2 located around the gap S is approximately 1800 K, and in case that, for example, tungsten is used as the material of the anode, the thermal expansion coefficient is about 38×10−7/K. In such a case, when the diameter of the anode body portion which is substantially used is about ϕ4 mm, it is possible to completely prevent direct contact between the anode 2 and the coil 20.

In addition, the reason that the width of the gap S is 0.3 mm or less is that mercury will enter the gap S from the light emitting portion 10 if the width of the gap S is greater than 0.3 mm, and therefore, a moderate amount of mercury light emission will not be obtained in the light emitting portion 10.

The anode 2 dose not need to be extended with the same diameter from the light emitting portion 10, and as shown in FIG. 2C, the anode 2 may have somewhat reduced diameter in a sealing portion 11. However, the diameter of the thick diameter portion 22 of the anode 2 in the sealing portion 11, may be 70% or more of the maximum diameter of the tip portion 21 in the light emitting portion 10, and preferably more than 80% thereof so as to secure the thermal capacity in the thick diameter portion 22.

The coil 20 is made of high purity tungsten material with a purity of more than 4 N (99.99%). This is because impurities in the coil 20 cause devitrification. Since in the discharge lamp 1 according to the present invention, there is the gap S between the anode 2 and the coil 20, and the silicate glass is influenced by the radiant heat from the anode 2 so that it is easy for the silicate glass to become high temperature, there is a high possibility that devitrification will occur for a shorter time if impurities are contained. Although the purity of the material is greater than 4 N (99.99%), a purity of 5 N (99.999%) or greater is more preferred.

The anode 2 has a reduced diameter portion 24 at the junction to the metallic foil 4. This is because the gap S between the metallic foil 4 and the anode 2 is reduced in order to increase the airtightness therebetween.

Specifically in FIG. 2A, 2B, and 2C, the diameter portion 24 is reduced to about one fourth (¼) of the thick diameter portion 22.

The intermediate portion 23 is located between the thick diameter portion 22 and the reduced diameter portion 24, easing very steep change of the diameter from the thick diameter portion 22 for securing thermal capacity to the reduced diameter 24 provided for the contact with the metallic foil.

As shown in FIG. 2B, it is possible to place the coil 20 on the intermediate portion 23.

As numerical examples about the structure shown in FIG. 2C, the outer diameter of the thick diameter portion 21 is selected from a range of ϕ0.8 to 4 mm, for example, 1.8 mm, the outer diameter of the intermediate portion 22 is selected from a range of ϕ0.6 to 3.6, for example 1.5 mm, and the outer diameter of the reduced diameter portion 24 is selected from a range of ϕ0.3 to 1.0 mm, for example 0.5. In addition, the length of the thick diameter portion 21 is selected from a range of 2 to 7 mm, for example, 3 mm, the length of the intermediate diameter portion 22 is selected from a range of 3 to 10 mm, for example 5 mm, the length of the reduced diameter portion 24 is selected from a range of 0.8 to 5 mm, for example 3 mm. The outer diameter of the coil 20 is selected from a range of ϕ0.9 to 4 mm, for example, 1.8 mm, which is placed in a 5 mm length portion of the thick diameter portion 22.

These numerical examples may change depending on the design of the discharge lamp 1. The anode 2 may be disposed in the discharge lamp 1 with the numerical examples previously described.

Figure 3:
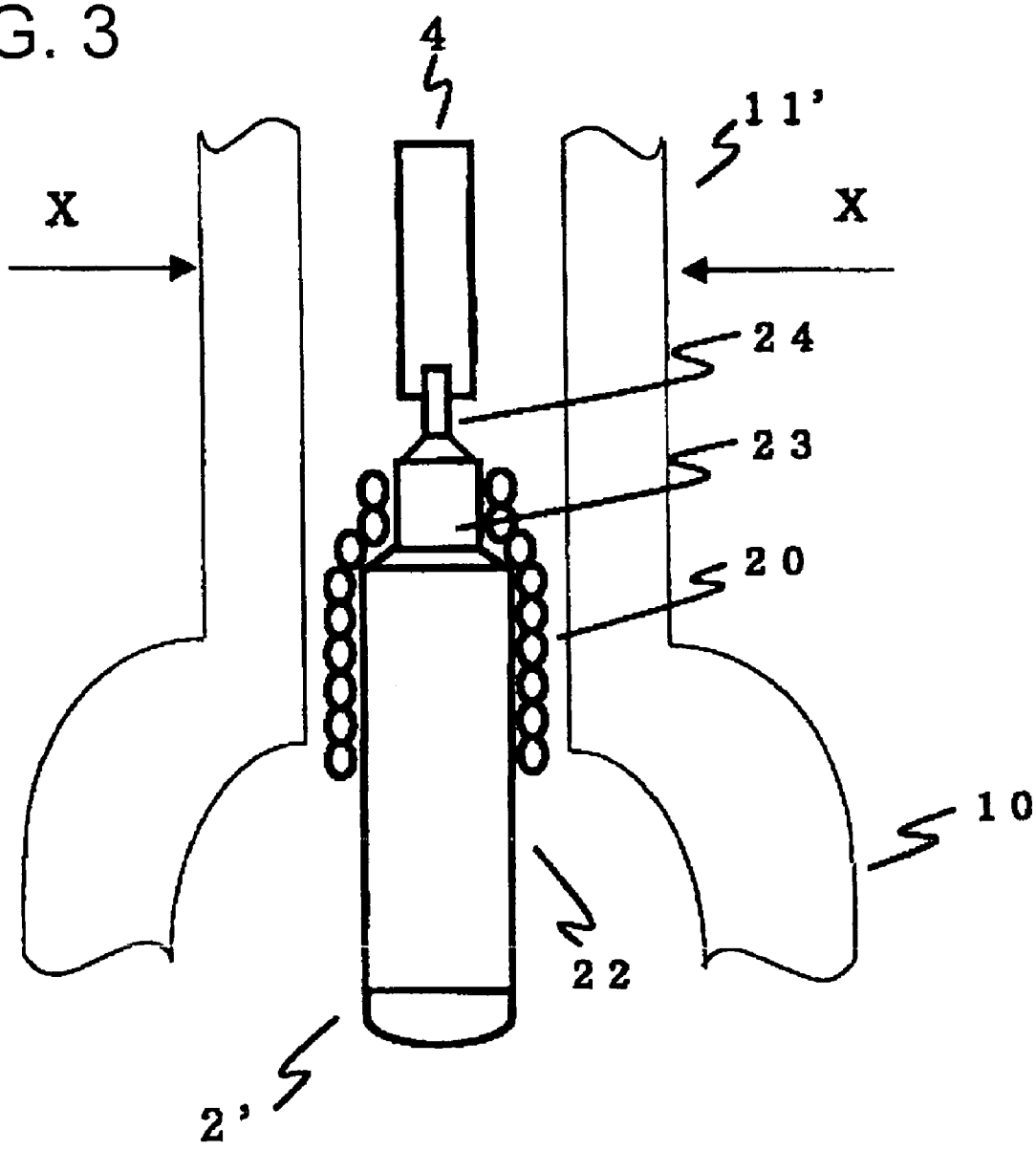
FIG. 3 is a schematic view for explaining the sealing process of the anode.

FIG. 3 is a schematic view for explaining a sealing process of the anode 2.

An anode assembly 2' is disposed so as to be hung in a silicate glass tube 11' which will become a sealing portion. In a state where the coil 20 is placed over the thick diameter portion 22 and the intermediate portion 23, and the reduced diameter portion 24 is joined to the metallic foil 4 by welding etc. In the thick diameter portion 22, the inner diameter of the coil 20 is 0.03 to 0.3 mm larger than the outer diameter of the thick portion 22. The coil 20 is mobably held only with the level difference of the thick diameter portion 22 and the intermediate portion 23. In the state shown in the figure, the sealing portion 11 can be formed by heating the silicate glass tube 11' from directions X, and at the same time by squeezing it (a squeezing process). This process is so-called a shrinking processing. It is possible to make such a sealing structure having a gap between the anode 2 and the coil 30 by the sealing process.

As shown in FIG. 2B, if the coil 20 has the structure in which the outer of the coil 20 diameter changes corresponding to the thick diameter portion 22 and the intermediate portion 23, since it is possible to hold both of them around the level difference portion of the thick diameter portion 22 and the intermediate portion 23, it is easy to assemble them. As shown in FIG. 2A and 2C, it is necessary to temporarily hold the coil 20 in case that the coil 20 has the structure in which the coil 20 just corresponds to the thick diameter portion 22.

The structure of this invention is also applicable to a direct-current lighting type discharge lamp or an alternate-current lighting type discharge lamp.

Further, although the above-mentioned embodiment is described as to the anode 2, a coil can also be provided on a cathode with a gap. Further, the structure according to the present invention can be applied to either a direct current lighting type discharge lamp, or an alternate current lighting type discharge lamp.

As described above, in the short arc type discharge lamp according to the present invention, at least one of the electrodes is extended inside the sealing portion with a thick diameter (almost no diameter change), and the coil 20 is wound around the circumference of the thick diameter portion in 23 the sealing portion 11 via a gap S. Thereby, it is possible to secure the thermal capacity of the at least one of the electrodes, 2 and 3, and it is possible to prevent cracks by avoiding contact of the electrode 2 and the silicate glass.

Thus the present invention possesses a number of advantages or purposes, and there is no requirement that every claim directed to that invention be limited to encompass all of them.

The disclosure of Japanese Patent Application No. 2003-117228 filed on Apr. 22, 2003 including specification, drawings and claims is incorporated herein by reference in its entirety.

Although only some exemplary embodiments of this invention have been described in detail above, those skilled in the art will readily appreciated that many modifications are possible in the exemplary embodiments without materially departing from the novel teachings and advantages of this invention. Accordingly, all such modifications are intended to be included within the scope of this invention.

What is claimed is:

1. A short arc type super high pressure discharge lamp having a pair of electrodes, a light emitting portion in which greater than 0.15 mg/mm$^3$ of mercury is enclosed, and sealing portions provided on both sides of the light emitting portion, wherein at least one of the pair of electrodes has a thick portion which extends into one of the sealing portions and a coil is wound around the thick portion of the at least one of the pair of electrodes in the one of the sealing portion via a gap.

2. The short arc type super high pressure discharge lamp according to claim 1, wherein the at least one of the pair of electrodes is an anode.

3. The short arc type super high pressure discharge lamp according to claim 2, wherein the width of the gap is 0.03 to 0.3 mm.

4. The short arc type super high pressure discharge lamp according to claim 2, wherein the thick portion of the one of the electrodes has a reduced thick portion whose diameter is greater than 70% of a maximum diameter of the thick portion in the light emitting portion.

5. The short arc type super high pressure discharge lamp according to claim 2, wherein the coil is made of tungsten with a purity of greater than 4N.

6. The short arc type super high pressure discharge lamp according to claim 1, wherein the short arc type super high pressure discharge lamp is a direct current type discharge lamp.

7. The short arc type super high pressure discharge lamp according to claim 6, wherein the width of the gap is 0.03 to 0.3 mm.

8. The short arc type super high pressure discharge lamp according to claim 6, wherein the thick portion of the one of the electrodes has a reduced thick portion whose diameter is greater than 70% of a maximum diameter of the thick portion in the light emitting portion.

9. The short arc type super high pressure discharge lamp according to claim 1, wherein the width of the gap is 0.03 to 0.3 mm.

10. The short arc type super high pressure discharge lamp according to claim 1, wherein the thick portion of the one of the electrodes has a reduced thick portion whose diameter is greater than 70% of a maximum diameter of the thick portion in the light emitting portion.

11. The short arc type super high pressure discharge lamp according to claim 1, wherein the coil is made of tungsten with a purity of greater than 4N.

12. A short arc type pressure discharge lamp, comprising:

a light emitting portion;

a pair of electrodes, having a thick diameter portion, an intermediate portion, and a reduced diameter portion, in which the thick diameter portion is the thickest among the portions, and the thick diameter portion extends into one of the sealing portions;

sealing portions provided on both sides of the light emitting portion; and a coil that is wound around the thick diameter portion in the one of the sealing portions via a gap.

* * * * *